United States Patent [19]

Müller et al.

[11] Patent Number: 4,742,667

[45] Date of Patent: May 10, 1988

[54] METHOD OF AND APPARATUS FOR STERILIZING PACKAGING MATERIAL, ESPECIALLY CONTAINER-TYPE PACKAGES

[76] Inventors: Horst Müller, Westerwaldweg 12, 4020 Mettmann; Gerhard Deimel, Kolberger Str. 83, 5090 Leverkusen 3, both of Fed. Rep. of Germany

[21] Appl. No.: 912,293

[22] Filed: Sep. 26, 1986

Related U.S. Application Data

[60] Division of Ser. No. 775,103, Sep. 11, 1985, Pat. No. 4,631,173, which is a continuation of Ser. No. 441,143, Nov. 12, 1982, abandoned.

[30] Foreign Application Priority Data

Nov. 14, 1981 [DE] Fed. Rep. of Germany ..... 3145274

[51] Int. Cl.[4] ..... A61L 2/20; B65B 55/10

[52] U.S. Cl. ..... 53/167; 53/425; 422/302; 422/304; 426/407

[58] Field of Search ..... 422/28, 29, 302, 303, 422/304; 426/407; 122/235 F, 4 A, 13 A, 32, 33, 20 B; 165/184; 219/301; 53/167, 425

[56] References Cited

U.S. PATENT DOCUMENTS

| | | | |
|---|---|---|---|
| 579,611 | 3/1897 | Smith | 122/4 A |
| 2,985,435 | 5/1961 | Gross | 165/184 |
| 3,421,840 | 1/1969 | Pechmann | 422/304 |
| 4,099,914 | 7/1978 | Gustafsson et al. | 422/29 |
| 4,225,556 | 9/1980 | Lothman et al. | 422/28 |
| 4,329,569 | 5/1982 | Hjortsberg et al. | 219/301 |
| 4,537,749 | 8/1985 | Hick | 422/304 |

*Primary Examiner*—David L. Lacey
*Assistant Examiner*—Floyd E. Bennett, Jr.
*Attorney, Agent, or Firm*—Sprung Horn Kramer & Woods

[57] ABSTRACT

An apparatus for packaging a product in containers includes a sterilization station and a conveyor for intermittently conveying containers to the sterilization station. A vaporizing nozzle communicates with a reservoir of liquid disinfectant containing hydrogen peroxide and a source of compressed air. The nozzle is intermittently opened and closed whereby the compressed air vaporizes the disinfectant and a mixture of liquid disinfectant in fine droplets and compressed air is ejected when the nozzle is open. A tube is connected with its intake end at the nozzle and is disposed parallel to the jet emitted from the nozzle. A heater on the tube heats the inner surface of the tube to a temperature that is sufficient high to rapidly evaporate the disinfectant in the mixture. As a result a mixed flow of compressed air and evaporated disinfectant leaves the output end of the tube and enters the container in the sterilization station.

11 Claims, 4 Drawing Sheets

Figure 1:
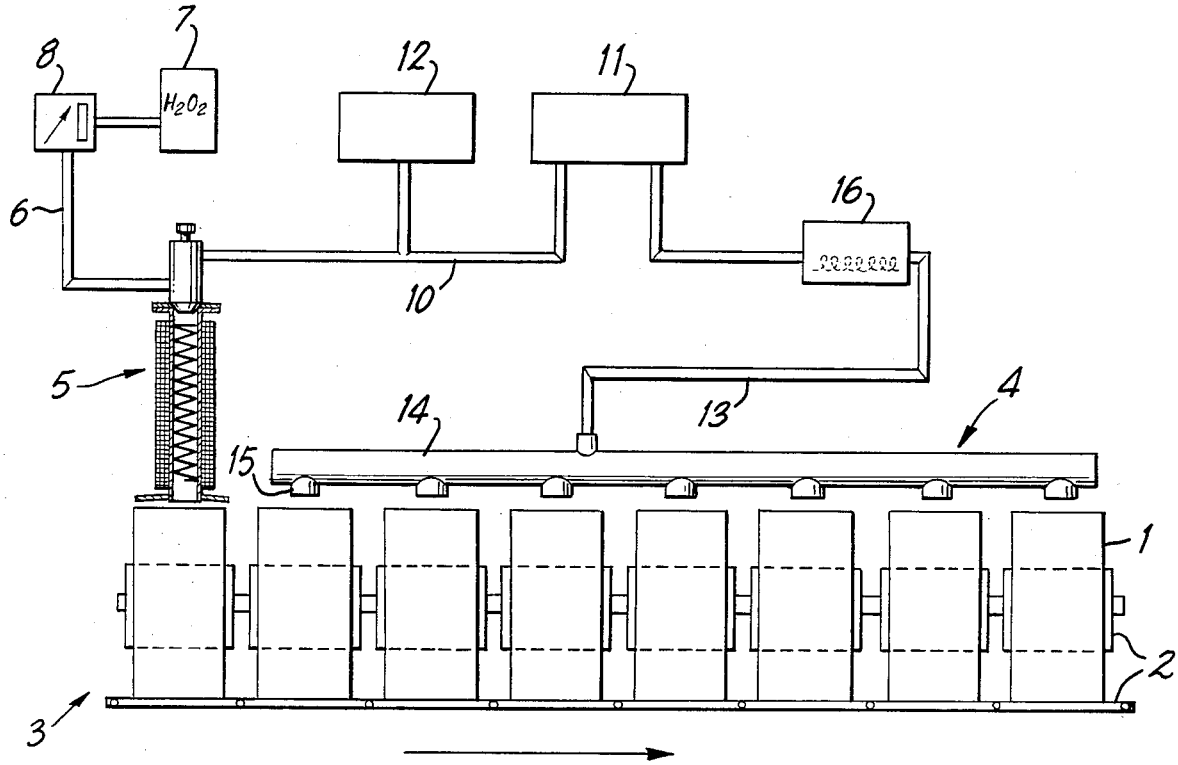

METHOD OF AND APPARATUS FOR STERILIZING PACKAGING MATERIAL, ESPECIALLY CONTAINER-TYPE PACKAGES

This is a division, of application Ser. No. 775,103, filed 9/11/85 and now U.S. Pat. No. 4,631,173 which is a continuation of Ser. No. 441,143, filed 11/12/82, now abandoned.

The invention concerns a method of sterilizing packaging material, especially container-type packages, with a liquid disinfectant containing hydrogen peroxide, a method in which the disinfectant is atomized and combined with compressed air and the combination evaporated and blown in the form of a mixture of vapor and air over the area of packaging material to be sterilized, where the vapor is condensed. The invention also concerns apparatus for carrying out this method.

The germicidal action of hydrogen peroxide has long been exploited in packaging technology. Various methods of applying more or less concentrated hydrogen peroxide to the packaging-material surface to be sterilized are known. In one known method (German AS 1 815 538) a liquid disinfectant that contains hydrogen peroxide is sprayed through an atomizer nozzle directly into container-type packages before they are filled with a product, and the resulting mist precipitates as fine droplets of water on their walls. Hot air is then introduced into the packages to evaporate the hydrogen-peroxide mist and decompose the hydrogen peroxide into the active state, in which it is finally expelled from the package.

In another and similar known method (German AS No. 2 744 637 and OS No. 2 310 661), to which the present invention is applicable, a liquid disinfectant that contains hydrogen peroxide is atomized and then evaporated with hot air, after which the mixture of vapor and air is blown over the area to be disinfected. Since the temperature of the area to be disinfected is kept lower than the dew point of the mixture of vapor and air, a condensate will form on it. In this method the disinfectant is atomized with an ultrasound nozzle, through which the disinfectant is blown in the form of a fine mist into a mixing chamber subjected to hot air. The disinfectant mist will, because of the fineness of its droplets, continuously evaporate inside the mixing chamber, and the resulting mixture of vapor and air is continuously blown through a tube that communicates with the mixing chamber into a chamber that the packaging material continuously travels through in the form of a web.

This known method is practical for sterilization processes in which the disinfectant is applied to the packaging material in cycles, as in the known method (AS 1 815 538) mentioned in the foregoing, only when certain disadvantages that can impair its effectiveness are taken into account. To ensure that a complete dose of the mixture of vapor and air formed out of the disinfectant can be obtained during the brief interval during which the work unit is performed, to completely exploit the germicidal action, that is, it must be provisionally stored in a buffer reservoir, which it is extracted from at controlled intervals and blown over the packaging material. This is because ultrasound atomizing, which is necessary to obtain droplets of the desired fineness, can not be initiated rapidly enough for the mist to be available precisely at the commencement of a work unit. Still, it is undesirable to store the mixture of vapor and all because the hydrogen peroxide, brought to a high temperature by the hot air, tends to decompose prematurely and the germicidal action of the mixture that is ultimately blown over the packaging material deteriorates.

The present invention is intended as a method of the type described in the foregoing and as apparatus for carrying out the method that can be employed for the cyclic sterilization of packaging material without detriment to its germicidal action.

This objective is attained in accordance with the invention in that the disinfectant is atomized with compressed air onto a heated surface and hence evaporated and in that the mixture of vapor and air is immediately blown over the area to be sterilized.

In the method in accordance with the invention, the liquid disinfectant is atomized directly by the compressed air, which then becomes a carrier for the disinfectant as the process continues, itself. The disinfectant can for example be vaporized with a binary nozzle, so that it can also be mixed as required with the compressed air at the same time that it is being finely divided into droplets. Atomizing the disinfectant onto a heated surface that has a temperature considerably higher than the evaporating point of the disinfectant evaporates the droplets extraordinarily rapidly as they strike the surface. The resulting vapor is immediately entrained by the current of compressed air generated during atomization and arrives immediately, within fractions of a second, that is, at the cooler packaging-material area that is to be sterilized, where it condenses as a fine film or in finely divided droplets. The amount of condensate can be controlled with extreme precision by varying the amount of disinfectant that is atomized.

One embodiment of the invention considerably promotes the distribution of vapor within the current of air that derives from atomization by generating powerful turbulence in the current of air or of vapor and air. This turbulence can be generated by directing the jet of compressed air that atomizes the disinfectant obliquely against the heated surface, which has projections or irregularities that produce the turbulence.

As mentioned in the foregoing, the actual sterilization is the result of the condensation of the mixture of vapor and air on the packaging-material surface, which is kept cool for this purpose, the temperature of the material being definitely below the dew point of the mixture. The film of condensate is subsequently dried in a known manner by blowing hot air over it.

In one somewhat different embodiment of the invention, however, the area to be sterilized is heated before the mixture of vapor and air is blown onto it to a temperature equal to or only slightly below the dew point of the mixture. This also produces, although only very briefly, a film of condensate on the surface being treated. This condensate evaporates by itself because of the released heat of vaporization and the resulting local temperature elevation. When the hydrogen-peroxide concentration is high enough (40% for instance), the film of condensate will remain on the surface long enough to sterilize it. Subsequent drying with hot air is not necessary and heat-sensitive packaging materials can be dried with relatively cooler air.

In another embodiment of the method, the wall surfaces of container-type packages that are to be sterilized and that have wall surfaces of different temperature are variably cooled or heated to equalize the temperatures in the areas to be sterilized. The temperatures may be non-uniformly distributed for instance when packages are washed with hot water or a similar material immediately before being filled with a product and the varying wall thickness will result in irregular cooling as they reach the sterilization station. Packages made of cardboard blanks and with heat-sealed floors will also continue to exhibit a higher temperature at the floor, which is folded into several layers and retains heat from the sealing process, than at the walls, which are not subjected to sealing, during sterilization. The controlled cooling of such heated areas will balance the temperature and promote uniform condensation over all the areas to be sterilized.

The apparatus for carrying out the method in accordance with the invention has a conveyor for transporting the packaging material, especially container-type packages, a reservoir holding a liquid disinfectant that contains hydrogen peroxide and communicating with a device that atomizes the disinfectant, an evaporator downstream of the atomizing device, and a tube charged with compressed air, communicating with the evaporator, and opening above the packaging material in the vicinity of the conveyor.

The problems discussed in the foregoing are solved in accordance with the invention in that the device that atomizes the disinfectant is an atomizer nozzle charged with compressed air and positioned immediately in front of the entrance to the tube with the axis of its jet at least approximately parallel to the axis of the tube in the vicinity of the entrance and in that the inside surface of the tube can be heated by a heating device to a temperature that is definitely higher than the evaporation temperature of the disinfectant.

The inside surface of the tube is the heated surface that the mixture of finely atomized disinfectant and compressed air produced by the atomizer nozzle arrives at. The thrust of compressed air produced by the atomizer nozzle and the rapid evaporation of the droplets arriving at the inside surface of the tube blows a jet that consists of a mixture of vapor and air out of the tube exit, which is positioned immediately above the packaging material, above the open top of a package for instance.

It is practical for the atomizer nozzle to be immediately in front of the tube entrance, to which it may even be rigidly attached. The tube is enclosed over most of its length in a preferably electric heating jacket that supplies enough heat to keep the temperature of the inside surface of the tube high enough in spite of the amount of heat removed during every evaporation process.

In one practical embodiment of the invention the inside surface of the tube has projections to increase the heat-emission surface and also produce turbulence. In one ingenious solution these projections can be formed by a helical metal spring that fits deep into the tube. Its outer surface can be ground cylindrical if need be to increase the contact surface with the inside surface of the tube. It is also practical for at least one deflecting body to be inserted in the tube, extending from the inside surface to beyond the middle of the free tube cross-section, to prevent droplets ejected from the atomizer nozzle from traveling directly along the (straight) axis of the tube to its exit, so that they do not get evaporated.

Figure 2:
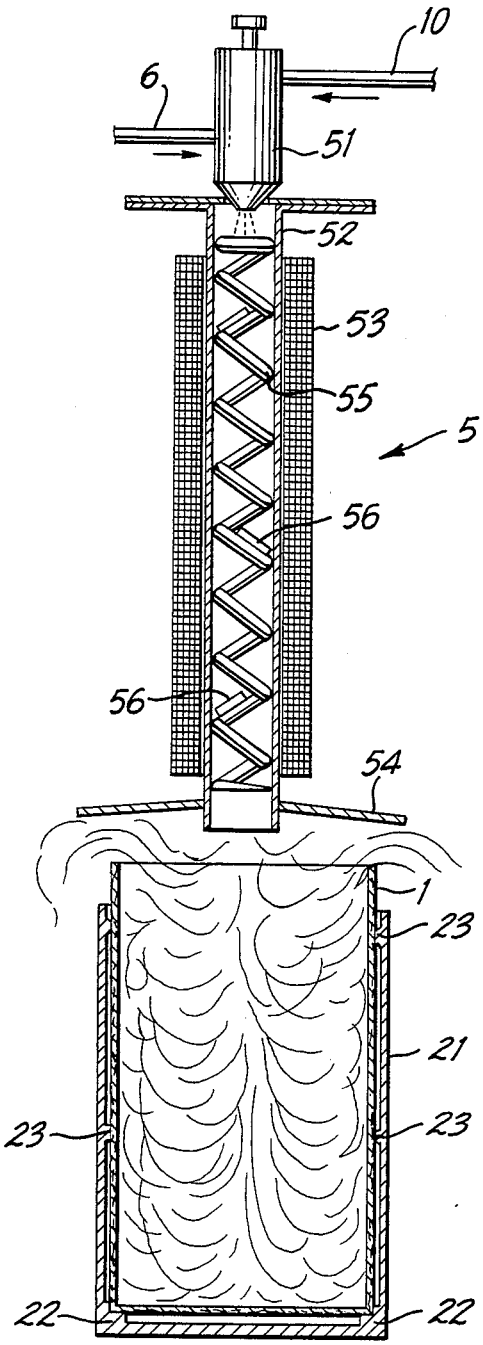
Figure 3:
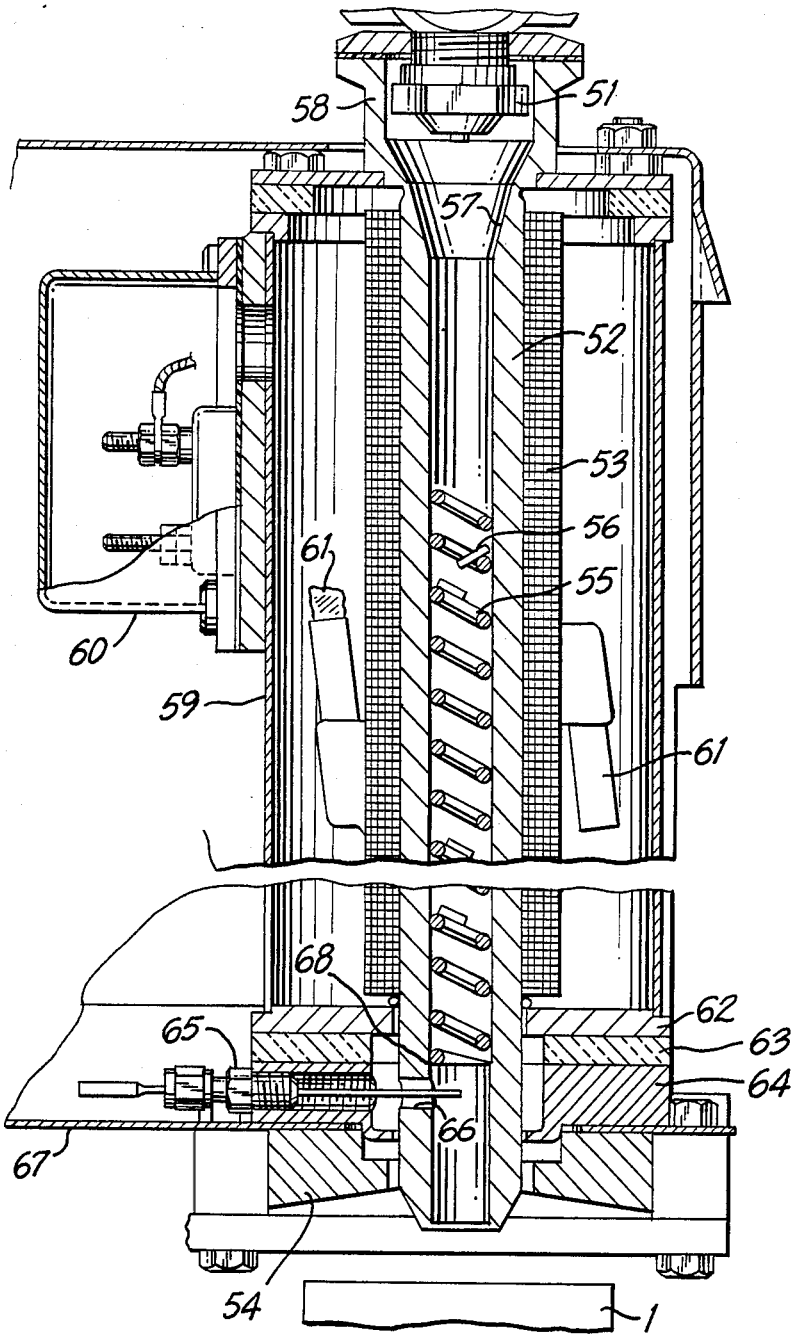
Figure 4:
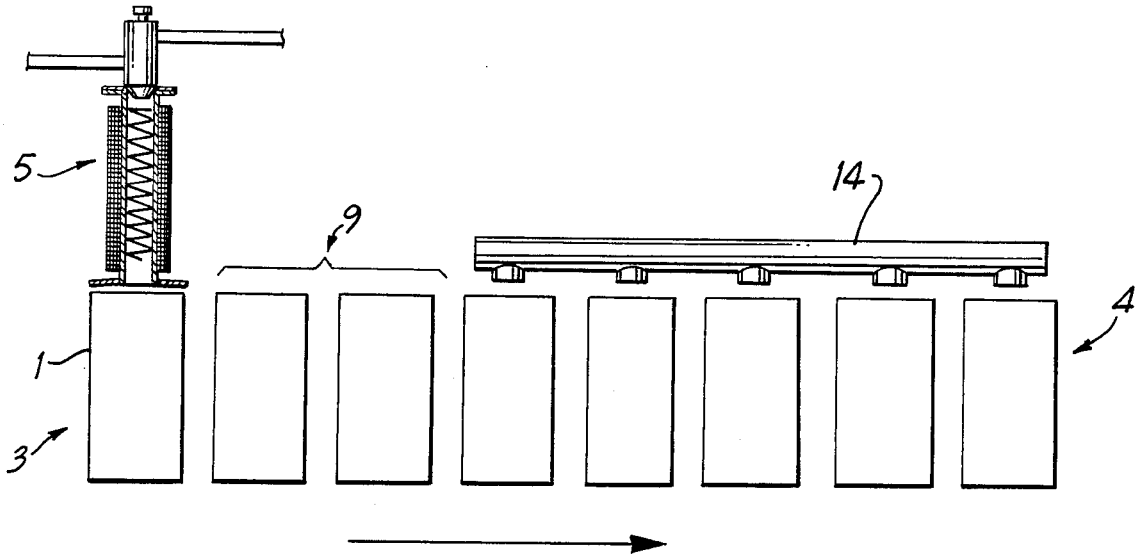
Figure 5:
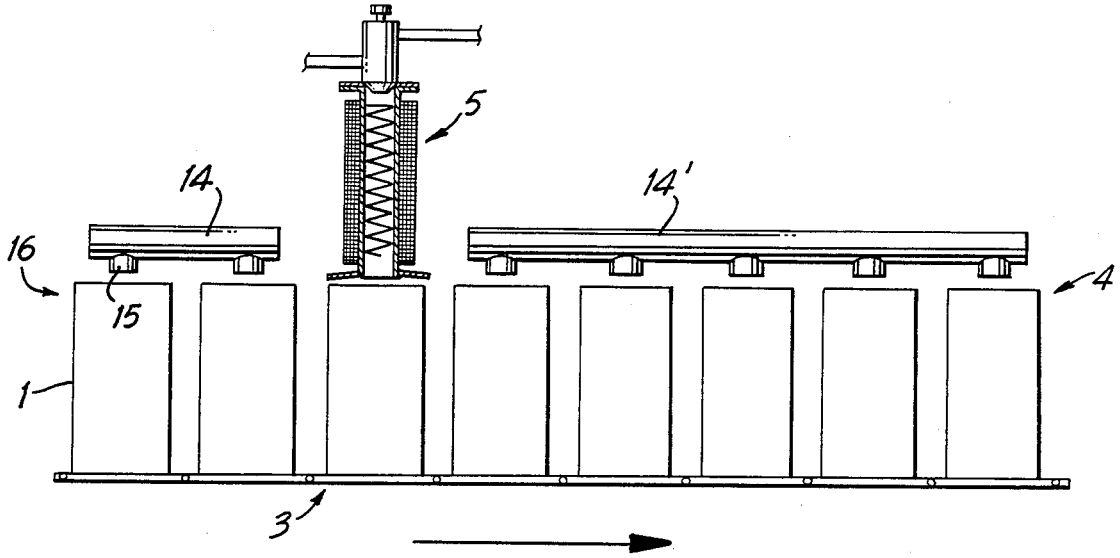

Other advantages and characteeristics of the present invention will be evident from the following specification of examples of embodiments with reference to the accompanying drawings and from the subsidiary claims. In the drawings, FIG. 1 is a schematic representation of apparatus in accordance with the invention, FIG. 2 a larger-scale schematic representation of the combination atomizer, evaporator, and blower device employed in the apparatus illustrated in FIG. 1, FIG. 3 illustrates one practical embodiment of the combination device illustrated in FIG. 2, FIG. 4 is a diagram illustrating a method of operation that differs slightly from that illustrated in FIG. 1, and FIG. 5 illustrates another embodiment that differs slightly from that illustrated in FIG. 1.

FIG. 1 is a schematic representation of apparatus for sterilizing container-type packages 1. This apparatus is part of a packaging plant, the other parts of which are not illustrated and in which the packages, manufactured from thermoplastic-coated cardboard blanks, are sterilized, filled with a product, milk for example, and finally sealed. Plants of this type are known and need not be specified herein.

Packages 1 are transported in a schematically illustrated conveyor 2, which may be a cell chain or similar mechanism, in which they are held positively and upright. The conveyor advances packages 1 at regular intervals of 3 seconds for example in the direction indicated by the arrow. At the conveyor entrance packages 1 pass through a sterilization station 3 and then through a drier station 4 that consists of seven individual positions, each with its own work interval.

A combination atomizer, evaporator, and blower device 5, which will be separately specified subsequently, is mounted above the path of packages 1 in the sterilization station, which is labeled on the whole with reference number 3. Device 5 communicates through a line 6 with a reservoir 7 of liquid disinfectant, which may for example be a 40% aqueous solution of hydrogen peroxide. Line 6 contains a flow-control device 8, in itself known, through which precisely measured and variable portions of disinfectant are supplied to device 5. Device 5 also communicates through a line 10 with a source 11 of compressed air, a compressor for example, which is illustrated completely schematically. The supply of compressed air is monitored and controlled by controls 12, which are also illustrated only schematically.

Compressed-air source 11 also communicates with a hot-air distributor 14 in drier station 4 through a line 13. Blower nozzles 15 are positioned extending down from hot-air distributor 14 in such a way that they can blow sterile hot air at a specific temperature (80° C. for example) into packages 1 in each of the seven individual positions in drier station 4. The compressed air is heated by a heater 16 positioned between compressed-air source 11 and hotair distributor 14.

FIG. 2 illustrates combination atomizer, evaporator, and blower device 5 in greater detail. This figure also illustrates a cell chain 2 that is somewhat different from that illustrated in FIG. 1. Device 5 is essentially a commercially available binary atomizer nozzle 51 that communicates through line 6 with disinfectant reservoir 7 and is charged through line 10 with compressed air. An upright tube 52, made out of a material like metal that conducts heat well, is positioned coaxial with the axis of the jet from atomizer nozzle 51 and enclosed in an electric heating jacket 53. Tube 52 opens immediately above the open top of a container-type package 1. A slightly peaked baffle 54 is mounted at the exit of tube 52 and extends somewhat beyond the cross-section of package 1. A helical spring 55, preferably made out of chrome-nickel steel, fits into tube 52 in such a way that its coils are in heat-conducting contact with the inside surface of the tube. Three deflection plates 56 are attached to spring 55 at approximately equal intervals along the axis of the tube. Deflection plates 56 in the form of a circle with a segment cut out and slant from the inside surface of tube 52 across its cross-section to beyond its longitudinal axis, so that only part of the open cross section of the tube is available for flowthrough. Deflection plates 56 are locally welded or soldered to spring 55. In the embodiment illustrated by way of example in FIG. 2, spring 55 extends along almost the total length of tube 52.

Although the cell 21 of cell connveyor 2 illustrated in FIG. 2 is manufactured in a known way out of metal, it has, in accordance with the invention, beads 22 and 23 on its bottom and sides respectively that extend inward so that the package 1 in cell 21 comes into contact only with their relatively narrow edges. The lines at which beads 22 and 23 contact package 1 can also be coated with a heat-insulating material to prevent heat from flowing from cell 21 into the walls of packages 1 or vice versa, leading to uncontrollable and undesirable changes in the temperature of the package wall.

In the practical embodiment of combination atomizer, evaporator, and blower device 5 illustrated in FIG. 3, atomizer nozzle 51, which is of a commerically available type, is attached, screwed for example, directly to the top 57 of tube 52. The top 57 of the tube accordingly expands like a funnel, forming a connector 58 that completely surrounds atomizer nozzle 51. The body, not illustrated in FIG. 3, of atomizer nozzle and its associated connections are outside connector 58. The tube illustrated in FIG. 3 is for example 28 cm long and its wall is 5 mm thick. This is to ensure that the wall of tube 52, which is electrically heated externally by heating jacket 53, will have enough thermal capacity that no, or only insignificant, temperature fluctuations will occur in it during operation. Tube 52 and heating jacket 53 are mounted in a housing 59 that has a junction box 60 for the electricity for jacket 53 mounted on it. The electrical connections 61 for jacket 53 are not completely illustrated. Tube 52 extends through the floor 62 of tube 52. The underside of floor 62 is protected with heat insulation 63. A thermostat 65 is positioned below heat insulation 63 in a mount 64. Thermostat 65 extends through a hole 66 bored in tube 52 and controls the supply of heat to heating jacket 53 and hence the temperature of the inside surface of tube 52 in accordance with the temperature of the mixture of vapor and air flowing through the tube. Baffle 54 is attached to the underside of a plate 67 on which housing 59 is mounted.

In the embodiment illustrated in FIG. 3, the helical spring 55 inside tube 52 does not extend along the whole length of the tube, but only from its exit to about ¾ of its length. Several deflection plates 56 shaped as described with reference to FIG. 2 are distributed at irregular intervals along the inside of tube 52. To prevent it from being displaced by the water hammer of atomizer nozzle 51, spring 55 rests on a shoulder 68 in tube 52.

How the method in accordance with the invention is carried out in conjunction with the apparatus specified with reference to FIGS. 1 through 3 will now be specified.

Programmed by the controls, not illustrated, for the overall packaging plant, cell chain 2 advances one step until a package 1 arrives at sterilization station 3 (FIG. 1). Atomizer nozzle 51 will subsequently be controlled by the programming and by controls 12 in such a way that compressed air will be supplied to it through line 10 and a dosage of disinfectant that has been prescribed by metering device 8 will be supplied to it through line 6. Atomizer 51 will also be operated at previously selected intervals of time. It employs the compressed air supplied to it to atomize the disinfectant in a known manner to a mist with a mean droplet size of approximately 20–50μ. The water hammer that occurs as the result of the position of atomizer nozzle 51 directly in front of the entrance to tube 52 (FIG. 2) or in connector 58 (FIG. 3) flings the droplets of the mixture of air and disinfectant against the inside surface of the tube, where they evaporate very rapidly because of the temperature prevailing there. Although a film of liquid disinfectant may tend to collect at the entrance to tube 52 during atomization, the powerful current will entrain it to the vicinity of helical spring 55, where turbulence will seize it and it will rapidly evaporate upon contact with the heated surface. Spring 55 will in any case prevent liquid disinfectant from leaving tube 52. Deflection plates 56, which partly block the inside cross-section of tube 52, will prevent droplets expelled parallel to the axis of the tube from precipitating unevaporated out of it and getting into package 1. A directed jet of a mixture of vapor and air leaves the exit of tube 52 and enters package 1, where it strikes against the walls and floor. since the walls and the floor of package 1 are at a temperature below (20° C. below, for example) the dew point of the mixture of vapor and air, the moisture in the mixture will condense on the inside surface of package 1, forming a thin and uniform film of disinfectant. Since the packages 1 in the embodiment illustrated in FIG. 2 are held in cell 21 in such a way that they contact the cell only at the edges of beads 22 and 23, there will be no preferred-condensation areas in which larger droplets can form and that would be difficult to dry during the subsequent drying process.

Since the mixture of vapor and air is supplied in excess to package 1, some of it will exit at the top, where, however, it will be diverted by baffle 54 to and will sterilize the cut edges and the inside and outside borders of package 1.

After one work interval, conveyor 2 will travel on and package 1 will arrive with the film of condensate on its walls at the first position of drier station 4. The film of condensate is completely eliminated as the package travels at regular intervals through the seven positions of drier station 4, in which hot air is blown from hot-air distributor 14 into package 1. Since the hot air has a temperature of only 80° C. for example, no excess heat is supplied to the walls of the package, which is a special advantage with regard to thermoplastic-coated packages, especially at the scoring.

This prevents damage to the thermoplastic coating. The apparatus illustrated in FIG. 4 differs from that in FIG. 1 in that the hot-air distributor 14 in drier station 4 extends over only five positions and in that there is a reaction station 9 that the package travels through in two work intervals upstream of drier station 4. The condensate is allowed to remain on the inside surface of the package as it travels through reaction station 9 so that the disinfectant will have enough time to completely kill off even especially resistant germs.

In the apparatus illustrated in FIG. 5, the process of atomization, evaporation, and blowing occurs as specified in the foregoing. This embodiment differs, however, in that the inside surfaces of packages 1 are preheated in a preheating station 16 that is upstream of sterilization station 3 and that it takes two work intervals for them to travel through to a temperature equal to or slightly below the dew point of the mixture of vapor and air produced in apparatus 5. A hot-air distributor 14 is mounted above the path of packages 1 through preheating station 16 to preheat them with hot air blown through their nozzles 15. The disinfectant in the mixture of vapor and air that is blown into packages 1 in sterilization station 3 also condenses in this embodiment on the inside surface of the packages, but only briefly because the vaporization heat released during condensation heats the surface to slightly above the dew point, so that the surface itself can evaporate the recently formed film of condensate. Since the condensate remains on the surface only briefly, the air that is supplied over a drying-air distributor 14' in order to dry packages 1 in the drier station 4 downstream of sterilization station 3 can be relatively cool.

If the walls of floor of packages 1 exhibit a nonuniform temperature distribution as the result of previous heat treatment, as will be the case when the floor has recently been heat-sealed, it may be necessary to cool them locally to allow or to prevent condensation. In this case it will be practical, instead of supporting the packages 1 with the beads 22 as illustrated in FIG. 2, to provide the cells with a floor on which the package will stand flat. The floor of the cell will remove heat locally from the floor of the package as it travels to the sterilization station and assimilate its temperature to that of the walls. If this heat removal is not adequate, the floor of the package can be locally cooled further by cold-air nozzles, not illustrated, positioned below conveyor 2.

The amount of disinfectant in the mixture of vapor and air, the temperature of the mixture, and the temperatue of the walls of the packages are all adjusted to control the extent to which the disinfectant condenses on the walls.

The temperature of the inside surface of tube 52 ranges from 250° to 300° C.

We claim:

1. In an apparatus for packaging a product in containers and comprising a sterilizing station and conveying means for the intermittent conveyance of containers to the sterilizing station, and an improved means for sterilizing the containers in the sterilizing station comprising:

a reservoir accommodating a liquid disinfectant, a source of compressed air, a vaporizing nozzle in communication with the reservoir through a disinfectant-supply line and with the source of compressed air through a compressed-air supply line, means for intermittently opening and closing the vaporizing nozzle, whereby the compressed air vaporizes the disinfectant and a mixture of liquid disinfectant in fine droplets and compressed air is ejected in the form of a jet having an axis when the nozzle is open, a tube with a longitudinal axis, with an intake end and an output end, and with an inner surface, wherein the tube is positioned with its intake end in flow communication with the nozzle, and the longitudinal axis of the tube is substantially parallel to said axis of the jet and wherein the output end of the tube extends inside a container in the sterilizing station, and heating means on the tube for heating the inner surface of the tube to a temperature that is sufficiently high to rapidly evaporate the disinfectant in the mixture, whereby the mixture of disinfectant and compressed air is blown into the intake end of the tube when the vaporizing nozzle is open such that the droplets of disinfectant in the mixture come into contact with the heated inner surface and rapidly evaporate and a mixed flow of compressed air and evaporated disinfectant leaves the output end and enters the container.

2. Apparatus as in claim 1, wherein the inside surface of the tube has projections along at least part of its length.

3. Apparatus as in claim 1, wherein the tube (52) is straight and wherein at least one deflecting body (56) is inserted in the tube extending from the inside surface to beyond the middle of the tube cross-section.

4. Apparatus as in claim 1, further comprising a baffle (54) connected to the tube at the output end and above the container (1) to be sterilized and diverts the mixture of evaporated disinfectant and air leaving the container through the top thereof to the upper edges of the container and adjacent areas of the container.

5. Apparatus as in claim 1, wherein the conveying means (2) has cells (21) that accept the container (1) positively and that have narrow beads (22, 23) on their inside surfaces that support the container (1).

6. Apparatus as in claim 5, wherein at least the areas of the beads (22, 23) that come into contact with the outside surfaces of the container (1) are made of heat-insulating material.

7. Apparatus as in claim 1, wherein the vaporizer nozzle (51) is rigidly attached by a closed funnel-shaped connector (58) to the intake end of the tube (52).

8. Apparatus as in claim 7, wherein the inside surface of the tube is funnel shaped at the intake end.

9. Apparatus as in claim 7, wherein the inside surface of the tube has projections along at least part of its length.

10. Apparatus as in claim 9, wherein the part of the inside surface of the tube that is near the output end has the projections.

11. Apparatus as in claim 10, wherein the projections are formed by a metal screw spiral (55) that fits tightly against the inside surface of the tube.

* * * * *